US006808017B1

(12) United States Patent
Kaellis

(10) Patent No.: US 6,808,017 B1
(45) Date of Patent: Oct. 26, 2004

(54) HEAT EXCHANGER

(76) Inventor: Joseph Kaellis, 5700 Etiwanda Ave., Suite 287, Tarzana, CA (US) 91356-2500

( * ) Notice: Subject to any disclaimer, the term of this patent is extended or adjusted under 35 U.S.C. 154(b) by 389 days.

(21) Appl. No.: 09/680,387

(22) Filed: Oct. 4, 2000

Related U.S. Application Data

(60) Provisional application No. 60/157,880, filed on Nov. 5, 1999.

(51) Int. Cl.[7] ..... F28F 9/24; F28F 13/12; F28F 1/24

(52) U.S. Cl. ..... 165/159; 165/109.1; 165/181; 165/162

(58) Field of Search ..... 165/109.1, 159, 165/162, 133, 181, 183, 184

(56) References Cited

U.S. PATENT DOCUMENTS

| | | | | |
|---|---|---|---|---|
| 2,362,694 A | * | 11/1944 | Hill | 165/162 X |
| 3,326,282 A | * | 6/1967 | Jenssen | 165/162 X |
| 3,720,259 A | | 3/1973 | Fritz et al. | 165/162 |
| 3,837,397 A | | 9/1974 | Pettigrew | 165/162 |
| 3,941,188 A | | 3/1976 | Scheidl | |
| 3,996,102 A | | 12/1976 | Thome | |
| 4,136,736 A | | 1/1979 | Small | 165/162 |
| 4,204,570 A | | 5/1980 | Eisinger | 165/162 X |
| 4,210,202 A | | 7/1980 | Boyer et al. | |
| 4,311,187 A | | 1/1982 | Small | |
| 4,398,595 A | | 8/1983 | Small | |
| 4,402,359 A | | 9/1983 | Carnavos et al. | |
| 4,588,027 A | * | 5/1986 | McClintock | 165/159 |
| 4,708,198 A | | 11/1987 | Holl | |
| 4,796,695 A | | 1/1989 | Cannon | |
| 4,809,415 A | * | 3/1989 | Okayama et al. | 165/133 X |
| 5,181,560 A | * | 1/1993 | Burn | 165/162 |
| 5,255,737 A | * | 10/1993 | Gentry et al. | 165/159 |
| 5,577,555 A | | 11/1996 | Hisajima | |

OTHER PUBLICATIONS

Bell, Kenneth J., *Delaware Method for Shell Side Design*, Chapter 6, pp. 129–166.

Bell, Kenneth J., *Exchanger Design*, Petro/Chem Engineer, Oct. 1960, pp. C–26—C–40c.

Bennett, C.O., *Momentum, Heat and Mass Transfer*, McGraw–Hill Book Company, Inc. (1962), pp. 305–306.

Buschman, H.W., *Design and Operating Experience of EBR–11 Intermediate Heat Exchanger*, American Society of Mechanical Engineers, Jul. 20, 1979, pp. 1–10.

(List continued on next page.)

*Primary Examiner*—Leonard Leo
(74) *Attorney, Agent, or Firm*—Sheldon & Mak

(57) ABSTRACT

The invention is a shell and tube type heat exchanger that provides a greater heat transfer coefficient to pressure drop ratio. The invention includes a mini-vortex generator on the surface of tubes within the tube bundle in the shell of the heat exchanger. The mini-vortex generator increases the heat transfer coefficient for grid baffle type heat exchangers having a longitudinal shell fluid flow without resulting in a significant increase in pressure drop. The invention also includes a sinuous-type grid baffle which permits a greater tube packing density and reduced pressure drop in a heat exchanger having longitudinal shell fluid flow. The invention also encompasses a shell and tube heat exchanger having mini-vortex generators and sinuous baffles.

5 Claims, 2 Drawing Sheets

OTHER PUBLICATIONS

Butterworth, D., *Developments in Shell–and–Tube Heat Exchangers*, International Center for Heat and Mass Transfer ICHMT International Symposium on New Developments in Heat Exchangers, Lisbon, Portugal, Sep. 6–9, 1993.

Gentry, C.C., *RODbaffle Heat Exchanger Technology*, Chemical Engineering Progress, Jul. 1990, pp. 48–57.

Gomelauri, V., *Influence of Two–Dimensional Artificial Roughness on Convective Heat Transfer*, 1964, Int. J. Heat Mass Transfer, vol. 7, pp. 653–663.

Kaellis, J., *Unsteady Coupled High Flux–Mass and Momentum Transfer With A Moving Boundary*, Chemical Engineering Science (1977), vol. 32, pp. 135–148.

McAdams, William H., *Heat Transmission*, McGraw–Hill Book Company, Inc. (1954), pp. 213–214.

Mukherjee, R., *Don't Let Baffling Baffle You*, Chemical Engineering Progress, Apr. 1996, pp. 72–79.

Mukherjee, R., *Effectively Design Shell–and–Tube Heat Exhangers*, Chemical Engineering Process, Feb. 1998, pp. 21–23.

Taborek, J., *Longitudinal Flow in Tube Bundles with Grid Baffles*, Heat Transfer—Philadelphia AIChe Symposium Series (1989), pp. 72–78.

Williams, F. *Heat Transfer From Surfaces Roughened by Ribs*, Augmentation of Convective Heat and Mass Transfer, Winter Annual Meeting, New York, NY, Dec. 2, 1970, pp. 36–43.

* cited by examiner

HEAT EXCHANGER

RELATED APPLICATIONS

This invention is a continuation-in-part of U.S. Provisional Patent Application 60/157,880, filed Nov. 5, 1999 entitled "Heat Exchanger with Vortex Generator and Slat Baffles", which is hereby incorporated by reference in it's entirety.

FIELD OF THE INVENTION

This invention relates generally to shell and tube heat exchangers, and, more specifically to mini-vortex generators and sinuous baffles used in shell and tube-type heat exchangers.

BACKGROUND OF THE INVENTION

Heat transfer is an important engineering concern for many process. Heat exchangers are a well known apparatus for transferring heat from one medium to another. There are many types of heat exchangers, including for example shell and tube designs, double pipe type shell and tube designs, plate and frame designs, plate-fin designs, and others. These heat exchangers are used in many industries, including those engaged in generating energy, producing chemicals, refining petroleum products, and air conditioning. All of these industries would stand to benefit from a more efficient heat exchanger design.

A common goal in the design of shell and tube-type heat exchangers is to enhance heat transfer while trying to keep the associated pressure drop low, or in other words to maximize the ratio of the heat transfer coefficient to the pressure drop. The higher the pressure drop, the more energy must be expended to pump the fluids through heat exchanger.

A problem with existing shell and tube type heat exchanger designs is a failure to maximize the heat transfer coefficient while keeping the pressure drop to a minimum. This is evidenced in shell and tube exchangers utilizing segment type baffles, which generate flow perpendicular to the tube bundle, which is otherwise known as crossflow. These baffles have a high heat transfer coefficient but also have a high pressure drop resulting from the crossflow. Alternatively, current commercial designs utilizing grid baffles with flow parallel to the tube bundle, have a low pressure drop but have a less favorable heat transfer coefficient. Consequently the overall efficiency, as measure by the ratio of the heat transfer coefficient to pressure drop, is not maximized in current shell and tube type heat exchangers.

What is needed is a shell and tube type heat exchanger that improves upon the heat transfer coefficient to pressure drop ratio of current shell and tube heat exchangers utilizing grid type baffles.

SUMMARY

The invention satisfies this need. The invention is a shell and tube type heat exchanger that provides a greater heat transfer coefficient to pressure drop ratio and is thus more efficient.

The heat exchanger has a shell and a tube bundle inside the shell. The tube bundle includes a plurality of substantially parallel tubes for passage of a first fluid. At least a portion of the tubes have a mini-vortex generator on their exterior surface. The heat exchanger further includes a grid baffle between the tubes, a tube inlet for passage of the first fluid into the tubes, and a tube outlet for passage of the first fluid out of the tube. The shell has a shell outlet for passage of a second fluid into the shell and exterior to the tubes and a shell outlet for withdrawing a second fluid from the shell.

In another embodiment, the heat exchanger has a shell and a tube bundle inside the shell. The tube bundle includes a plurality of substantially parallel tubes for passage of a first fluid. In this embodiment, the heat exchanger has sinuous baffles for supporting the tubes. Each sinuous baffle includes a plurality of wiggle bar tube support members disposed between the tubes. The heat exchanger further includes a tube inlet for passage of the first fluid into the tubes and a tube outlet for passage of the first fluid out of the tube. The shell has a shell outlet for passage of a second fluid into the shell and exterior to the tubes and a shell outlet for withdrawing the second fluid from the shell.

In another embodiment, the heat exchanger has sinuous baffles and at least a portion of the tubes of the heat exchanger have a mini-vortex generator on their exterior surface.

In operation, when the first and second fluid are passed countercurrent, cocurrent, or in multi-pass substantially parallel flow, and when the fluids are at different temperatures, a transfer of heat occurs between the fluids.

DRAWINGS

These features, aspects and advantages of the present invention will become better understood with regard to the following description, appended claims and accompanying figures where:

DETAILED DESCRIPTION

Figure 3:
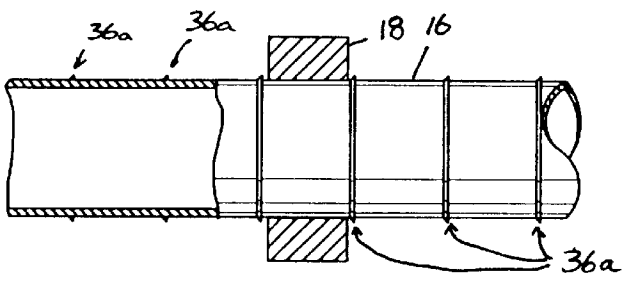
FIG. 3 is a side elevation in partial cross-section of the heat exchanger illustrated in FIG. 1, taken along line 3—3.

The following discussion describes in detail one embodiment of the invention and several variations of that embodiment. This discussion should not be construed, however, as limiting the invention to those particular embodiments. Practitioners skilled in the art will recognize numerous other embodiments as well.

The invention is a heat exchanger 10 having a shell 12, a tube bundle 14 having a plurality of tubes 16 within the shell 12, and a grid baffle 18 between the tubes 16.

The shell 12 encloses the tube bundle 14 and holds the shell fluid 20 as it passes against the exterior of the tubes 16. The shell 12 typically has two outlets, a first shell outlet 22 for passage of the shell fluid 20 (otherwise referred to herein as the second fluid) into the shell 12 and a second shell outlet 24 for withdrawing the shell fluid 20 from the shell 12 and out of the heat exchanger 10. The outlets are typically configured as nozzles. As illustrated in the embodiments in the Figures, the shell 12 is typically a pipe, rolled cylinder, or similar such cylindrical tank-like structure. The diameter of the shell 12 is typically between about 8" and about 30", or other sizes as needed. More typically, the diameter of the shell 12 is between about 12" and about 25". The length of the shell 12 is typically between about 10 feet and about 45 feet.

Figure 1:
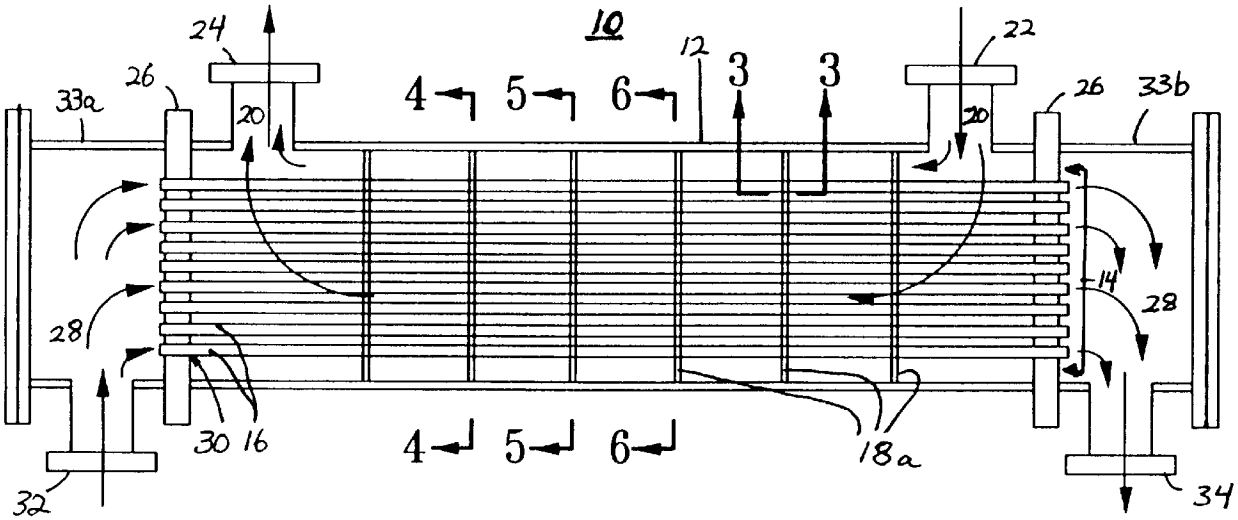
FIG. 1 is a cross-sectional side view of a heat exchanger having features of the invention.

As illustrated in the embodiment in FIG. 1, the tube bundle 14 comprises two tube sheets 26 that are affixed to the shell 12. The tube sheets 26 separate the tube fluid 28 (otherwise referred to herein as the first fluid 28) from the shell fluid 20 and support the end portions of the tubes 16 within the shell 12. The tube sheets 26 have tube holes 30 through which the tubes 16 protrude. The tubes 16 are typically welded directly to the tube hole 30 of the tube sheet 26, or expanded by rolling to give a leak-proof fit. The tube sheet 26 is typically a metal such as steel, aluminum, admiralty metal, or others.

In another embodiment (not shown), one tube sheet 26 is affixed to the shell 12 and the other tube sheet 26 is floating and is not affixed to the shell 12. This design permits the tubes bundle 14 to be removable. In still another embodiment (not shown), the tube bundle 14 comprises one tube sheet 26 with U-tubes.

As illustrated in FIG. 1 and FIGS. 4–6, the tube bundle 14 is comprised of a plurality of tubes 16 that are disposed substantially parallel to each other and parallel to the longitudinal axis of shell 12. As illustrated in FIG. 1, the heat exchanger 10 has a tube inlet 32 for passage of tube fluid 28 through a first header 33*a* into the tubes 16 and a tube outlet 34 for passage of the tube fluid 28 from the tubes 16 into a second header 33*b* and out of the heat exchanger 10. As illustrated, the tube inlet 32 and the tube outlet 34 are disposed on opposite ends of the heat exchanger 10. However, in multi-pass units (not shown) the tube inlet 32 and tube outlet 34 are disposed at the same end of the heat exchanger 10. The tubes 16 are typically formed of a metal, such as steel, copper, aluminum, or admiralty metal. The diameter of the tubes 16 is typically between about ½" and about 2". More typically, the diameter of the tubes 16 is between about ⅝" and 1".

Figure 2:
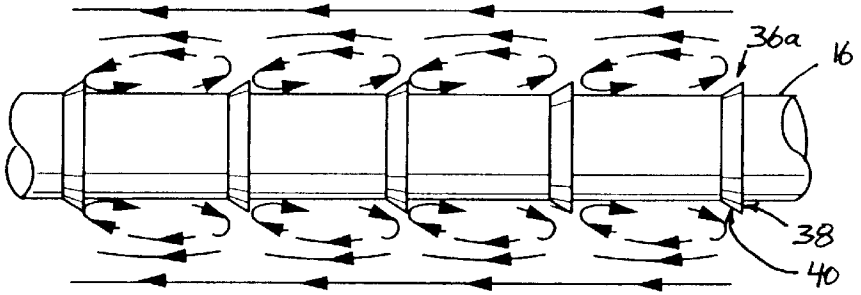
FIG. 2 is a perspective view of a heat exchanger tube, including an enlarged scale view of a mini-vortex generator having features of the invention.

In the embodiment illustrated in FIG. 2 and FIG. 3, at least a portion of the tubes 16 have a mini-vortex generator 36 on their exterior surface. The function of the mini-vortex generator 36 is to abruptly interrupt the flow of the shell fluid 20 proximal to the exterior surface of the tube 16. Preferably, the mini-vortex generators 36 comprise small protrusions on the external surface of the tubes 16 which interrupt the longitudinal flow of the shell fluid 20 proximal to the tubes 16 exterior surface. This interruption in fluid flow by the mini-vortex generators 36 results in a shell fluid 20 flow which can be described as recirculating, separated, or a vortex flow. The result is a disruption of the shell fluid 20 laminar sub-layer which exist in turbulent flow conditions and is proximal to the tube 16, and a corresponding disruption in the temperature profile close to the tube 16 wall. The vortex fluid flow process results in a decrease in resistance close to the exterior of the tube 16 wall and an increase in the heat transfer rate. The heat transfer benefit of the invention is generally greatest for fluids having a high or moderate Prandtl number where heat transfer occurs to a large extent by a movement of the fluid mass which contains the heat, as opposed to heat transfer in fluids with a low Prandtl number where heat is transferred predominantly by conduction.

In a preferred embodiment, the mini-vortex generators 36 are comprised of ridge members 36*a* that encircle at least a portion of the exterior surface of the tubes 16. Preferably, the ridge members 36*a* are integral with the tubes 16. In a preferred embodiments, the ridge members 36*a* have a flow blocking surface 38 that disrupts the longitudinal flow of the shell fluid 20 proximal to the exterior surface of the tubes 16. As illustrated in the embodiment in FIG. 2, the ridge members 36*a* are disposed generally perpendicular to the longitudinal axis of the tubes 16, and each ridge member 36*a* disrupts the shell fluid 20 flow predominantly upstream of itself. In a preferred embodiment (not shown), the ridge members 36*a* are configured as annular rings 36*a* that protrude from the external surface of the tubes 16.

In the embodiment illustrated in FIG. 2, the ridge members 36*a* have a sloped surface 40 that is disposed rearward of the flow blocking surface 38 such that the fluid vortex is created upstream of the flow blocking surface 38 and the surrounding shell fluid 20 passes by the slopped surface 40 after it encounters the flow blocking surface 38.

In other embodiments (not shown), the ridge member 36*a* has an alternative configuration in cross-section such as for example square, rectangular, beveled rectangular, or curved. In another embodiment (not shown), the mini-vortex generator 36 comprises spiral-like ridges 36*b* that wind around the exterior surface of the tubes 16. In still other embodiments (not shown), the mini-vortex generator 36 comprises alternative protrusions or alterations on the exterior surface of the tubes 16.

Preferably, the height of the ridge member 36*a* from the exterior tube 16 surface is between about 0.2 mm and about 1.0 mm on a tube 16 having a base diameter of between about ⅝" and about 1". Accordingly, the diameter of the portion of the tube 16 having a ridge member 36*a* is preferably greater than the base diameter by about 0.4 mm to about 2.0 mm. In other embodiments, the height of the ridge members 36*a* is greater. For example, a heat exchanger 10 using a shell fluid 20 that is high fouling or which tends to form deposits on the tubes 16 should utilize ridge members 36*a* of between about 1 mm and about 3 mm to offset deposit formation on the tubes 16 caused by the shell fluid 20. In still other embodiments, the height of the ridge members 36*a* is greater than 3 mm.

As illustrated in FIG. 2 and FIG. 3, there are typically a plurality of ridge members 36*a* disposed along the longitudinal axis of each tube 16. Preferably, the spacing between ridge members 36*a*, otherwise known as the pitch, is between about 2 mm and about 15 mm. Further preferable, the pitch of the ridge members 36*a* is between about 2.6 mm and about 13 mm. However, in other embodiments the pitch is between about 2 mm and about 40 mm. Generally, the pitch of the ridge members 36*a* increases in relation to their height. Typically, the pitch of the ridge members 36*a* is between about 10 times and about 15 times the height of the ridge members 36*a*. Preferably, the height of the ridge members 36*a* is selected to minimize the pressure drop of the shell fluid 20 while maximizing heat transfer. The width of each ridge member 36*a* is typically between about 0.2 mm and about 1.0 mm, and is variable when one or more surface of the ridge member 36*a* is sloped, beveled, curved, or otherwise non-rectangular in cross-section.

Baffles in a heat exchanger 10 function to support the tubes 16 and to direct the flow of the shell fluid 20. In the heat exchanger 10 illustrated in FIG. 1, there are a plurality of grid-type baffles 18. The term grid baffle 18 as use herein refers to a baffle that permits longitudinal shell fluid 20 flow (parallel to the longitudinal axis of the shell 12). In contrast, heat exchangers 10 utilizing segmented baffles generate a shell fluid 20 crossflow (perpendicular to the tube bundle 14) as opposed to a longitudinal flow (parallel to the tube bundle 14).

Each grid baffle 18 comprises a plurality of tube support members 42. Typically, each tube support member 42 is elongate and spans at least a portion of the shell 12 in a plane perpendicular to the longitudinal axis of the shell 12. Preferably, each tube support member 42 has opposed ends that are attached to a baffle hoop 44 that is disposed within the shell 12 in a plane substantially perpendicular to the tube bundle 14. The spacing of grid baffles 18 within the shell 12 depend on the tube 16 diameter. Tubes 16 having a 1" diameter are typically supported every 60" along the tubes 16 longitudinal axis, tubes 16 having a ¾" diameter are typically supported every 45", and tubes 16 having a ½" diameter are typically supported every 30–. The tubes 16 can be supported by baffles 18 at a shorter distance, however the Tubular Exchangers Manufactures Association (TEMA) calls for the spacing not to exceed these distances. Accordingly, since each grid baffle 18 may furnish only partial support for the tube 16, the baffle spacing generally does not exceed an integer fraction of 60, 45, or 30".

In the embodiment illustrated in FIG. 1 and FIGS. 4–6, the heat exchanger 10 comprises sinuous baffles 18*a* (referred to as slat baffles in related application No. 60/157,880), which are a type of grid baffle 18. As illustrated in these Figures, each sinuous baffle 18*a* has a plurality of tube support members 42 which are referred to herein as wiggle bars 42*a*. The wiggle bars 42*a* have a sinusoidal or wave-like configuration about a elongate axis that spans the baffle hoop 44, and the wiggle bars 42*a* are disposed between the tubes 16 to provide support for the tubes 16. A tube 16 can also be supported directly by the baffle hoop 44 on one side to maximize the tube 16 packing.

In a preferred embodiment, the heat exchanger 10 comprises groups of three sinuous baffles 18*a* whereby the elongated axis of the wiggle bars 42*a* of each sinuous baffle 18*a* are oriented at 60° relative to the nearest sinuous baffle. For example, in a heat exchanger 10 having tubes 16 with a 1" diameter the tubes 16 are supported by a sinuous type baffle every 20" or less (60 divided by the integer 3) and each baffle is rotationally disposed 60° relative to the nearest sinuous baffle. Tube support members 42 in a grid baffle 18 produce resistance to the longitudinal flow of the shell fluid 20. However this series of three sinuous baffles 18*a* allows maximal flow area at each sinuous baffle 18*a*, thus minimizing the resistance to the longitudinal flow of the shell fluid 20 while still providing tube 16 support.

In a preferred embodiment, the depth (dimension parallel to the longitudinal tube axis) of the wiggle bar 42*a* is between about ¼" and about ½". The spacing between tube centers, otherwise known as the tube 16 pitch, is typically 1¼ times the tube diameter as required by TEMA. The width of the wiggle bar 42*a*, the distance between the exterior surface of two adjacent tubes 16, is thus typically ¼ times the tube 16 diameter. The width of a wiggle bar 42*a* for a heat exchanger 10 utilizing tubes 16 with ¾" diameter is typically about 3/16". The width of a wiggle bar 42*a* for a heat exchanger 10 utilizing Lubes 16 with a 1" diameter is typically about ¼". The tube 16 pitch and wiggle bar 42*a* width may vary in alternative embodiments. In a heat exchanger 10 utilizing mini-vortex generators 36 and sinuous baffles 18*a,* the width of the wiggle bars 42*a* may be slightly less than ¼ times the tube 16 diameter in order to allow clearance for the mini-vortex generators 36.

Pitch to diameter ratios larger than required by TEMA give a less compact tube packing density. The advantage of sinuous baffles 18*a* is that they allow the tubes 16 to be oriented with a triangular pitch and with a tube to pitch ratio which does not exceed TEMA's requirements. A triangular pitch, as opposed to a square pitch permits a greater tube 16 packing density with about 15½% more tubes in the same diameter tube bundle 14.

In embodiments having multipass flow (not shown), the heat exchanger 10 typically further comprises one or more blocking bars integral with or attached to the baffles 18 at the pass section of the shell 12 to prevent shell fluid 20 bypass. Tube bundles 14 are, preferably packed as fully as possible with tubes 16 to eliminate large fluid passageways on the periphery of the tube bundle 14 which permit shell fluid 20 to bypass the tube bundle 14. Passageways which still remain are preferably blocked by attaching nodules or protrusions on the baffle hoop 44.

Figure 4:
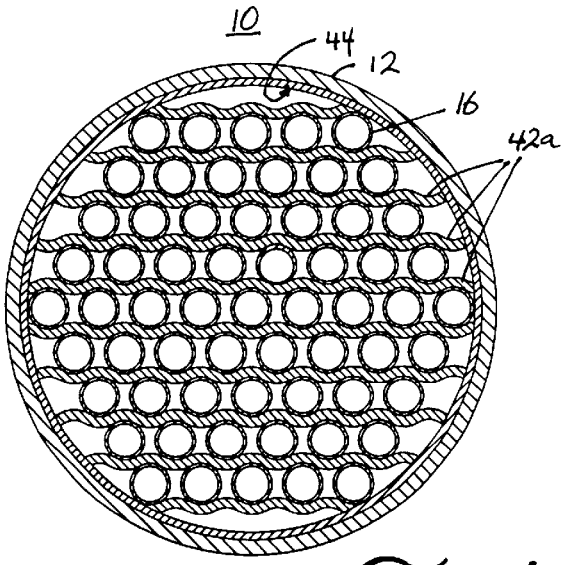
FIG. 4 is a cross-sectional view of the heat exchanger illustrated in FIG. 1, taken along line 4—4.
Figure 5:
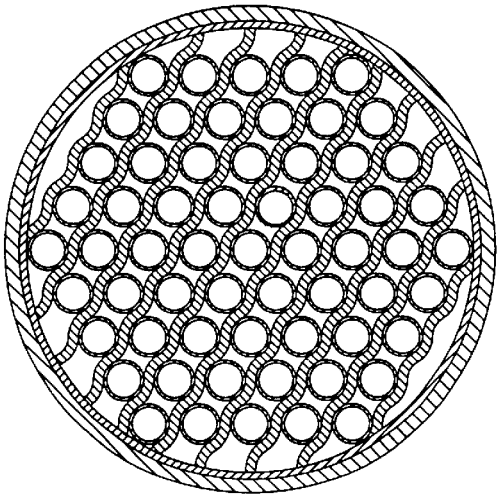
FIG. 5 is a cross-sectional view of the heat exchanger illustrated in FIG. 1, taken along line 5—5.
Figure 6:
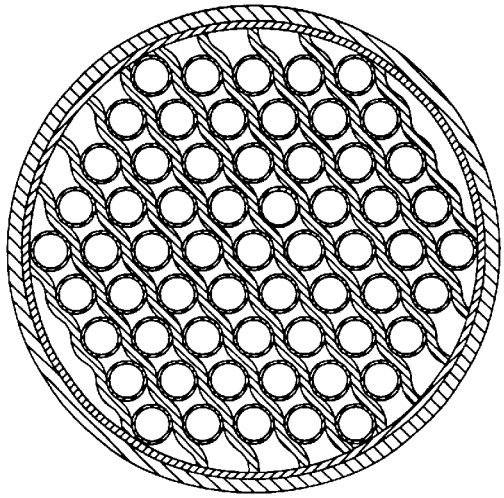
FIG. 6 is a cross-sectional view of the heat exchanger illustrated in FIG. 1, taken along line 6—6.

In the embodiment illustrated in FIGS. 4–6, for every sinuous baffle 18*a* each tube 16 is in contact and is supported by two wiggle bars 42*a*, with the exception of some tubes 16 disposed proximal to the baffle hoop 44. Preferably, each wiggle bar 42*a* is in contact with a portion of the circumference of external surface of each tube 16 defined by an arc (corresponding to an angle of a portion of the circular tube 16) of between about 30° and about 180°. Further preferable, each wiggle bar 42*a* is in contact with a portion of the circumference of each tube 16 defined by an arc (corresponding to an angle of a portion of the circular tube 16) of between about 45° and about 75°.

With reference to the first sinuous baffle 18*a* in a repeating series of three illustrated in FIGS. 4–6, a tube 16 contacts one wiggle bar 42*a* on one side of the tube 16 along about a 60° arc and the same tube 16 contacts another wiggle bar 42*a* along about a 60° arc on the opposing side of the tube 16. Accordingly, for each sinuous baffle 18*a* most tubes 16 are in supporting contact with a wiggle bar 42*a* over a total arc circumference corresponding to a combined angle of about 120°. The second sinuous baffle 18*a* in a series contacts the same tube 16 at two opposing arcs rotationally displaced about 60° from the first sinuous baffle, and the third sinuous baffle 18*a* in series contacts the same tube at two opposing arcs rotationally displaced about 60° from the second sinuous baffle. After three sinuous baffles 16, the tube 16 has been contacted three times at three adjacent sections of the tube 16 circumference, each contact being 120°, or a total of 360°, with depth of the contact surface being equivalent to the depth of the wiggle bar 42*a*. The tube 16 has now been contacted, and is supported around its entire periphery. The next sinuous baffle 18*a* begins a new series of three.

The invention further includes a method of heat exchange between fluids comprising utilizing the heat exchanger 10 described herein. In operation, the first and second fluid are passed either countercurrent, co-current, or in multi-pass with substantially parallel flow. Preferably, the first and second fluid are passed in substantially countercurrent directions (in opposite directions) or in multi-pass flow, and parallel to the longitudinal axis of shell 12. A transfer of heat occurs between the fluids when the first fluid and second fluid are at different temperatures.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A heat exchanger comprising:

(a) a shell;

(b) a tube bundle inside the shell, the tube bundle comprising a plurality of substantially parallel tubes for passage of a first fluid, each tube having a base diameter of between about 0.5" and about 1", at least a portion of the tubes having on their exterior surface mini-vortex generators comprising two or more ridge members that encircle at least a portion of the exterior surface of a tube, the height of each ridge member being between about 0.2 mm and about 1.0 mm, the spacing between any two ridge members being between about 2 mm and about 40 mm;

(c) a sinuous baffle for supporting the tubes, the sinuous baffle comprising a plurality of wiggle bar tube support members disposed between the tubes;

(d) a tube inlet for passage of the first fluid into the tubes and a tube outlet for passage of the first fluid out of the tube;

(e) a shell outlet for passage of a second fluid into the shell and exterior of the tubes and a shell outlet for withdrawing a second fluid from the shell, wherein the first and second fluid are passed either countercurrent, co-current, or in multi-pass substantially parallel flow, and when the fluids are at different temperatures, a transfer of heat occurs between the fluids.

2. The heat exchanger of claim 1 wherein the mini-vortex generator comprises at least one ridge member that encircles at least a portion of the exterior surface of the tube.

3. The heat exchanger of claim 2 wherein the ridge members have a flow blocking surface that disrupts the longitudinal flow of the second fluid proximal to the exterior surface of the tubes.

4. The heat exchanger of claim 1 wherein the spacing between any two ridge members is between 2.6 mm and about 13 mm.

5. The heat exchanger of claim 1 wherein the spacing between any two ridge members is between about 10 times and about 15 times the height of the ridge members.

* * * * *